US005085374A

United States Patent [19]

Okuda et al.

[11] Patent Number: 5,085,374

[45] Date of Patent: Feb. 4, 1992

[54] SPRAY PAINTING APPARATUS ARM SUPPORT

[75] Inventors: Masaharu Okuda; Kouichiro Asami, both of Tokyo; Heishiro Nagasaki, Yamato, all of Japan

[73] Assignee: Taikisha, Ltd., Tokyo, Japan

[21] Appl. No.: 592,671

[22] Filed: Oct. 4, 1990

[30] Foreign Application Priority Data

Oct. 5, 1989 [JP] Japan ..... 1-260941

[51] Int. Cl.[5] ..... B05D 1/02

[52] U.S. Cl. ..... 239/751; 239/752; 118/323

[58] Field of Search ..... 118/323, 6, 324, 631, 118/4, DIG. 7; 55/DIG. 46; 239/751, 752

[56] References Cited

U.S. PATENT DOCUMENTS 4,931,322 6/1990 Yamamoto et al. ..... 118/323
4,951,600 8/1990 Soshi et al. ..... 118/DIG. 7

FOREIGN PATENT DOCUMENTS 2637956 3/1978 Fed. Rep. of Germany .
1307444 11/1961 France .
62-234565 10/1987 Japan .
2-6868 1/1990 Japan .
2190312 11/1987 United Kingdom .

*Primary Examiner*—Richard V. Fisher
*Assistant Examiner*—Charles K. Friedman
*Attorney, Agent, or Firm*—Webb, Burden, Ziesenheim & Webb

[57] ABSTRACT

A spray painting apparatus having an arm attached with a spray nozzle and a support unit for pivotably supporting the arm via a pivot shaft. An arc-shaped guide is provided to either the arm or the support unit, with the guide being coaxial with and larger in diameter than the pivot shaft while a drive unit is provided to the other of the arm and the support unit so as to move either the support unit or the arm relative to and along a periphery of the arc-shaped guide.

5 Claims, 5 Drawing Sheets

SPRAY PAINTING APPARATUS ARM SUPPORT

BACKGROUND OF THE INVENTION

1. Field of the Invention

The present invention relates to a spray painting apparatus for spray-painting an object such as an automobile body, and more particularly to a spray painting apparatus of the above type having a spray nozzle arm pivotably supported to a support unit via a pivot shaft for allowing position adjustment of a spray nozzle by pivoting the arm in accordance with the shape of the object or other operational conditions.

2. Description of the Related Art

A spray painting apparatus of the above-described type is known from e.g. a Japanese patent application No. 63-157717 which is shown in FIG. 5.

In this conventional apparatus of FIG. 5, numeral 10 denotes an arm attached with a spray nozzle 11. Numeral 22 denotes a pivot shaft for operatively connecting the arm 10 to a lift unit 9 which is a support unit for the arm 11. The arm 10 is pivoted about an axis P through rotational drive force of the pivot shaft 22. Further, the arm 10 is reciprocable along the axis P through reciprocating sliding motions of the pivot shaft 22.

The lift unit 9 is liftable with respect to a base mount 8, while the mount 8 is movable along a direction of conveying the object. In summary, this conventional apparatus effects a spray painting operation on the object A while appropriately adjusting the position of the spray nozzle 11 by the combinational movements of: the motion of the base mount 8 along the object-conveying direction, the lifting motion of the lift unit 9, the pivotal motion of the arm 11 about the axis P and the reciprocating motion of the arm 10 along the axis P.

Numeral 35 denotes a valve unit for switching over feed of paint to the nozzle 11. This valve unit 35 is mounted on the lift unit 9 and is connected with a plurality of tubes 36 extending from the base mount 8 to the lift unit 9 so as to selectively feed a plurality of kinds of paint to the nozzle 11 through the valve unit 35.

In all the conventional apparatuses of this type including the one illustrated in and described above with reference to FIG. 5 (another such conventional apparatus is known from a Japanese laid-open patent gazette Serial No. 62-234565), the pivoting operation of the arm 10 is effected through the rotational drive of the pivot shaft 22 which supports the arm 10 to the support unit. In such apparatuses, there occurs disadvantageous concentration of the load of the arm 10 on the pivot shaft 22 and there arises also concentration of the reaction moment of the arm 10 (resulting from the pivotal motion of the arm 10) on this pivot shaft 22. As a result, there tends to occur excessive deformation in this pivot shaft 22 (i.e. elastic deformation and plastic deformation in the shaft periphery). This exessive deformation in the shaft 22 eventually makes it difficult or even impossible to accurately position the nozzle 11 with respect to the object to be painted; and such inaccurate positioning of the nozzle 11 necessarily leads to deterioration in the painting quality of the object.

Then, the primary object of the present invention is to overcome the above-described drawback of the convention through rational improvement of the pivot mechanism for the nozzle arm.

SUMMARY OF THE INVENTION

For accomplishing the above-noted object, a spray painting apparatus, according to the present invention, comprises: an arm attached with a spray nozzle; a support unit for pivotably supporting the arm via a pivot shaft; an arc-shaped guide provided to either the arm or the support unit and being coaxial with and larger in diameter than the pivot shaft; and drive means provided to the other of the arm and the support unit so as to move either the support unit or the arm relative to and along a periphery of the arc-shaped guide.

Further, according to one preferred embodiment of the invention, the drive means includes a rotary member rotatable about an axis parallel with a rotary axis of the arm and an open-loop transmission member for transmitting rotational drive force of the rotary member to the arc-shaped guide.

According to a further embodiment of the invention, the rotary axis of the arm is oriented substantially horizontal; the drive means is provided to the support unit and the rotary member is disposed upwardly of the arc-shaped guide.

According to a still further embodiment, the apparatus further comprises: peripheral support means for supporting the arm along the rotary axis thereof at a position on the outside of the pivot shaft within a pivotable stroke of the arm, while permitting the pivot motion of the arm.

According to a still further embodiment of the invention, the arm mounts a valve unit for switching over feed of paint to the spray nozzle.

Functions and effects of these features of the invention will now be described.

As the drive means provided to either the arm or the support drives to move the support unit or the arm relative to and along a periphery of the arc-shaped guide which is provided to the other of the arm and the support unit and is coaxial with yet larger in diameter than the pivot shaft, the drive means provides the drive force about the pivot shaft to pivot the arm about this shaft.

That is, the arm is pivoted not through the pivot shaft but through the relative movement between the drive means and the arc-shaped guide. Accordingly, the pivot shaft is free from the reaction force from the arm. For this reason, compared with the conventional apparatus in which the arm is pivoted by the rotational drive force of the pivot shaft, there hardle occur any errors in positioning of the nozzle due to the excessive deformation of the pivot shaft. Consequently, the paint quality deterioration of the object due to such nozzle position errors can be effectively avoided.

Further, since the arc-shaped guide has the larger diameter than the pivot shaft, compared with the convention where the arm is pivoted by driving the pivot shaft having the relatively small diameter, a very fine and accurate positioning of the arm is possible per unit pivot angle of the arm. In this respect too, the apparatus of the invention achieves even more accurate positioning of the spray nozzle.

If, according to the embodiment, the drive means includes the rotary member and the open-loop transmission member so that the rotational drive force of the rotary member is transmitted to the arc-shaped guide via the open-loop transmission member, the rotary member effects a planetary motion with respect to the arc-shaped guide. As a result, the drive means having the rotary member effects a relative movement with respect to the guide along the arc-shaped periphery of this guide so as to provide the arm with the rotational force about the pivot shaft.

This guide member construction where the opposed terminals of the open-loop transmission member are connected with the arc-shaped guide for assuring reliable power transmission from the rotary member and the arc-shaped guide, is advantageous for its simple and inexpensive construction as compared with the convention of gear-mechanism type arc-shaped guide construction.

Moreover, according to the further embodiment, if the rotary axis of the arm is oriented substantially horizontal and the drive means is provided to the support unit and the rotary member is disposed upwardly of the arc-shaped guide, the rotary member receives a part of the load of the arm through the open-loop transmission member thus reducing the vertical load acting on the pivot shaft. Accordingly, this construction is advantageous for further reducing deformation of the pivot shaft thus enabling further improvement of the paint quality of the object.

With the additional feature of the peripheral support means, this peripheral support means supports the arm along the rotary axis thereof at a position on the outside of the pivot shaft within a pivotable stroke of the arm. This is advantageous for reducing the bending moment acting on the pivot shaft in association with the pivot motion of the arm within the pivotal stroke thereof. Therefore, this feature too is advantageous for further restricting the deformation of the pivot shaft and thus further improving the paint quality of the object.

The further feature of mounting the valve unit on the arm is advantageous for eliminating the necessity of providing play to the paint tubes extending between the valve unit and the spray nozzle so as to allow the pivotal motion of the arm. Thus, the lengths of the paint tubes between the valve unit and the nozzle can be reduced. More specifically, according to the convention, since the paint-switchover valve unit 35 is mounted on the lift unit 9 which is the support unit for the arm 10, the tubes, which occasionally requires cleaning operation of paint remaining therein, must be provided with some play to allow the pivotal movements of the arm.

Further and other objects, features and effects of the invention will become more apparent from the following more detailed description of the embodiments of the invention with reference to the accompanying drawings.

BRIEF DESCRIPTION OF THE DRAWINGS

Accompanying drawings FIGS. 1 through 4 illustrate one preferred embodiment of the invention; in which, FIG. 1 is a section view showing an installment condition of a spray painting apparatus according to the invention, FIG. 2 is a front view of the apparatus, FIG. 3 is a side view of the apparatus, FIG. 4 is a perspective view showing the installment condition of the apparatus.

DESCRIPTION OF THE PREFERRED EMBODIMENTS

Figure 1:
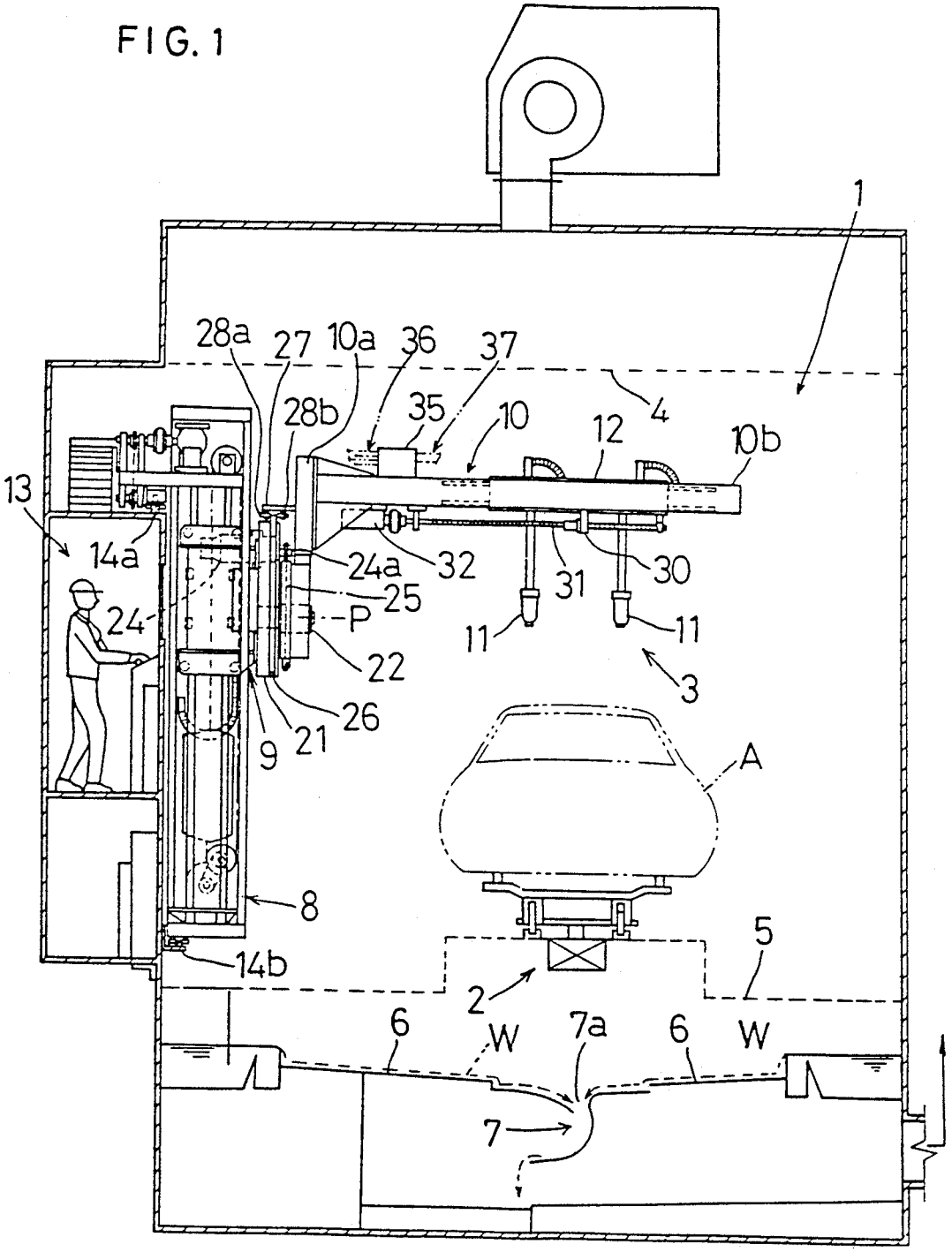
Figure 2:
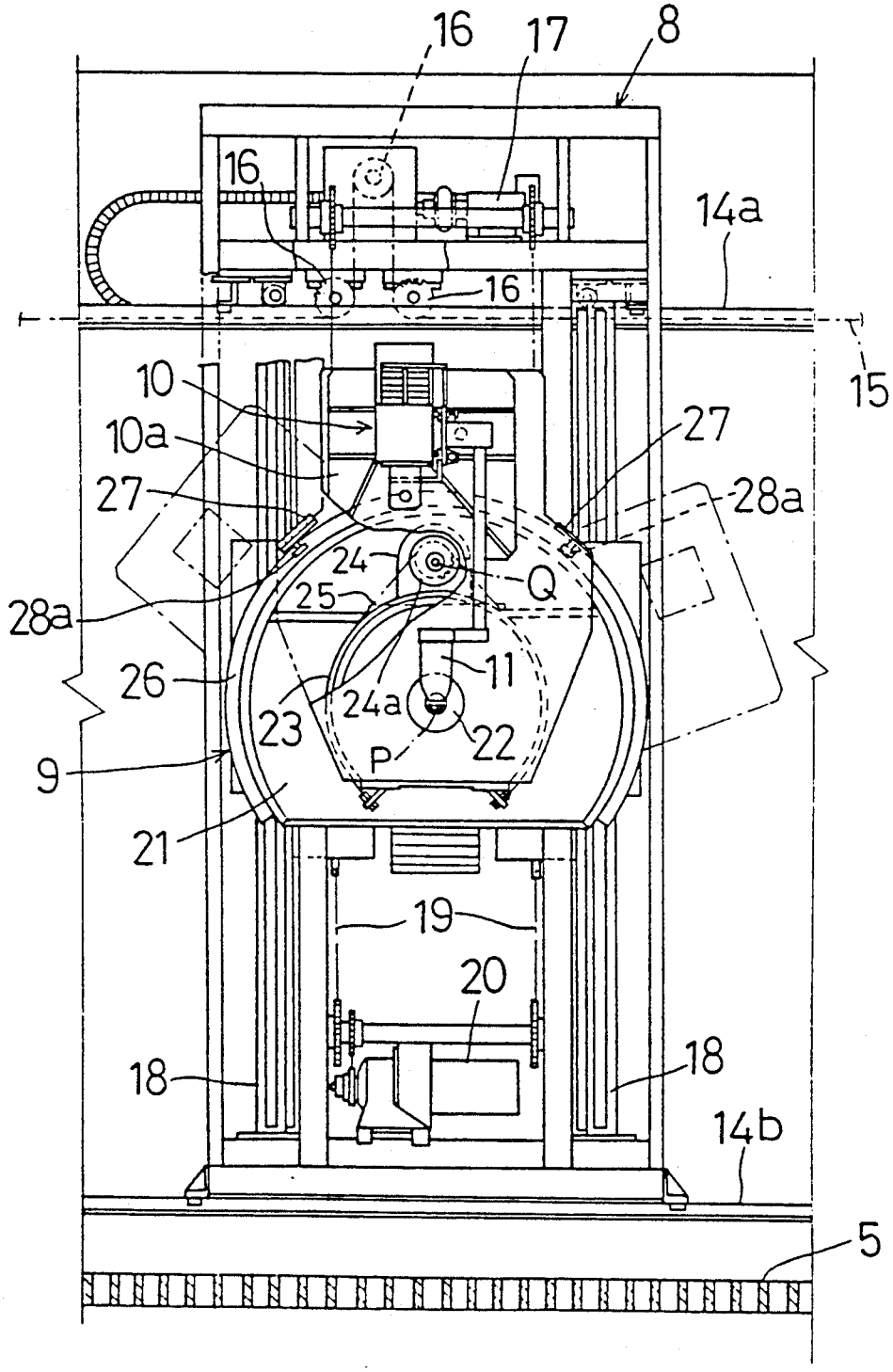
Figure 3:
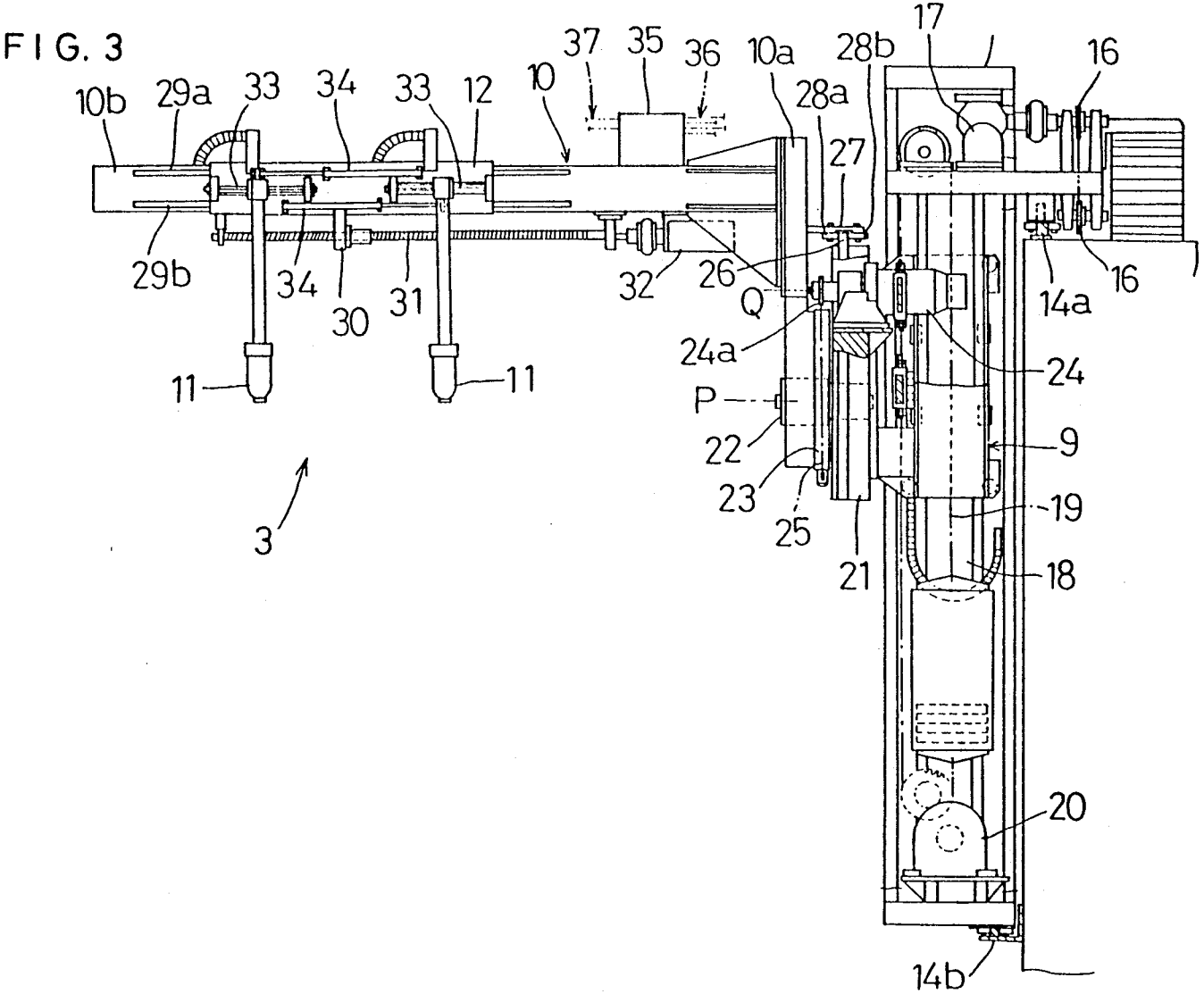
Figure 4:
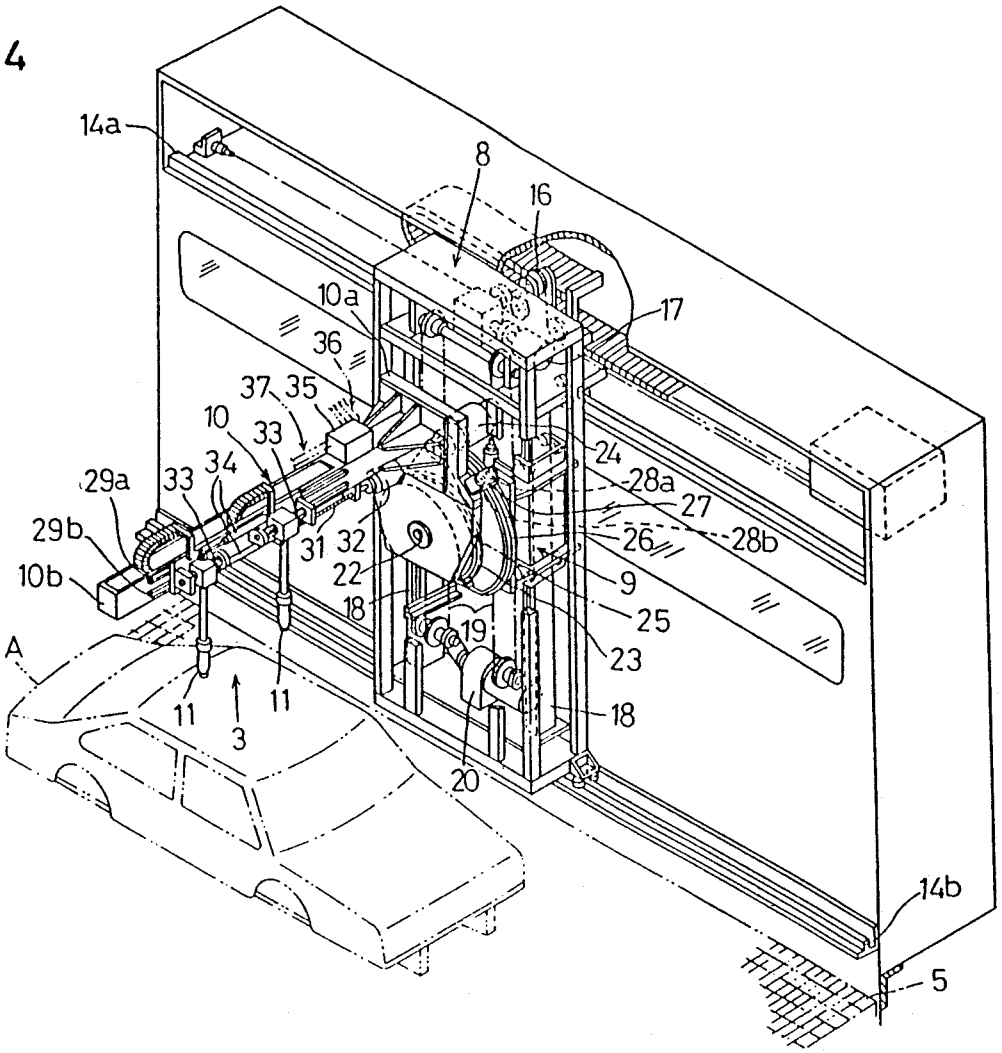

Preferred embodiments of a spray painting apparatus of the present invention will now be described in details with reference to the accompanying drawings.

In FIGS. 1 through 4 showing the apparatus of the invention, numeral 1 denotes a tunnel-like painting booth, numeral 2 denotes a conveyor device for conveying a work object A inside the booth 1, and numeral 3 denotes a spray painting apparatus body for spray-painting the object A.

Substantially the entire booth ceiling is constructed as an overhead air discharge vent 4 for downwardly discharging ventilating air through the entire opening thereof. Whereas, substantially the entire floor face is constructed as a grating floor for allowing passage of exhaust air therethrough. Numeral 6 denotes a cleaning-water flushing pan for receiving and flushing away dropplets of excess paint in cleaning water w. Numeral 7 denotes a demister for trapping and eliminating excess paint mist present in the exhaust air together with the cleaning water w by causing the combination to pass at a high velocity through a curved constricted flow passage 7*a*.

The spraying apparatus 3 includes a base mount 8 movable along the object-conveying direction, a lift unit 9 integrally and liftably connected with the mount 8 and an arm 10 extending from the lift unit 9 to be pivotable about a horizontal axis P extending normal to the object-conveying direction. This arm 10 is attached with a pair of spray nozzles 11.

The arm 10 is constructed as a letter-L shaped structure consisting of a base arm portion 10*a* extending along the pivot radius of the arm and a horizontal arm portion 10*b* extending along the arm pivot axis P. For attaching the spray nozzles 11 to this arm 10, the horizontal arm portion 10*b* of the arm 10 includes a slide table 12 which slides to reciprocate along the arm axis P. Further, the pair of nozzles 11 are supported to the slide table 12 so that discharge axes of the nozzles extend normal to the axis P and also that the discharging ends of the nozzles are positioned on the axis P.

In operation, through the combination of the movement of the base mount 8 along the object-conveying direction, the vertical movement of the lift unit 9, the pivotal movement of the arm 10 about the axis P and the sliding reciprocating movement of the slide table 12 along the axis P, the spray nozzles 11 can be appropriately positioned with respect to the object A for spray-painting the object.

Numeral 13 denotes an operator chamber accommodating various control devices for controlling the spray painting apparatus 3. The base mount 8 is moved and guided by an upper rail 14*a* and a lower rail 14*b*, with the load and weight of the mount 8 being supported on the upper rail 14*a*. Further, a chain 15 is layed along the upper rail 14*a* and this chain 15 is engaged with a sprocket 16. Then, as this sprocket 16 is driven by a motor 17 mounted on the base mount 8, the chain 15 is moved to move the base mount 8 along the object-conveying direction.

For vertically moving the lift unit 9, the base mount 8 mounts a pair of vertical guides 18 whereas the unit 9 is connected with a chain 19; then, a further motor 20 mounted on the base mount drives the chain 19 to lift up and down the lift unit 9 with the unit 9 being guided along the vertical guides 18.

For pivotably connecting the arm 10 to the lift unit 9, the arm 10 is connected with an arm support 21 attached to the left unit acting as the support for the arm so that a base end of the base arm portion 10*a* can freely pivot about a pivot shaft 22. Then, for pivotably driving this construction, the base arm portion 10*a* of the arm 10 mounts an arc-shaped guide 23 which is coaxial with and has a larger diameter than the pivot shaft 22. On the other hand, above this guide 23, there is provided a gear 24*a* as a rotary member to be driven by a motor 24 fixedly mounted on the arm support 21 so as to rotate about an axis Q parallel with the arm pivot axis P. Further, an open-loop chain 25, as a loop transmission means for transmitting the rotational force of the gear 24*a* to the arc-shaped guide 23, is entrained about this gear 24*a* with opposed terminal ends of the chain 25 being respectively connected with the arc-shaped guide 23 adjacent opposed edges thereof.

In operation, as the gear 24*a* is driven to rotate, the arm-pivot drive means including the motor 24 and the gear 24*a* effects a planetary motion relative to and along the periphery of the arc-shaped guide 23, so that the guide 23 is pivoted about the arm pivot axis P thus pivotably driving the arm 10.

To the arm support 21 adjacent the left unit 9, there is attached an arc-shaped rail 26 which is coaxial with the pivot shaft 22 and has a diameter even larger than the arc-shaped guide 23. On the side of the arm 10, a support arm 27 extending continuously from the base arm portion 10*a* carries a pair of rollers 28*a* and 28*b* which stride across to engage with the arc-shaped rail 26. The above-described components: the arc-shaped rail 26, the support arm 27 and the roller pair 28*a*, 28*b* together constitute peripheral support means for supporting the arm 10 along the rotary axis thereof at a position on the outside of the pivot shaft 22 within a pivotable stroke of the arm 10, while permitting the pivot motion of this arm 10.

The slide table 12 is slidable guided by means of rails 29*a* and 29*b* attached to the horizontal arm portion 10*b* of the arm 10 along the longitudinal direction of this horizontal arm portion 10*b*, i.e. along the arm pivot axis P. That is, the slide table 12 is slided back and forth as a motor 32 mounted on the horizontal arm portion 10*b* drives a ball screw 31 on which a ball-screw block 30 connected with the slide table 12.

Figure 5:
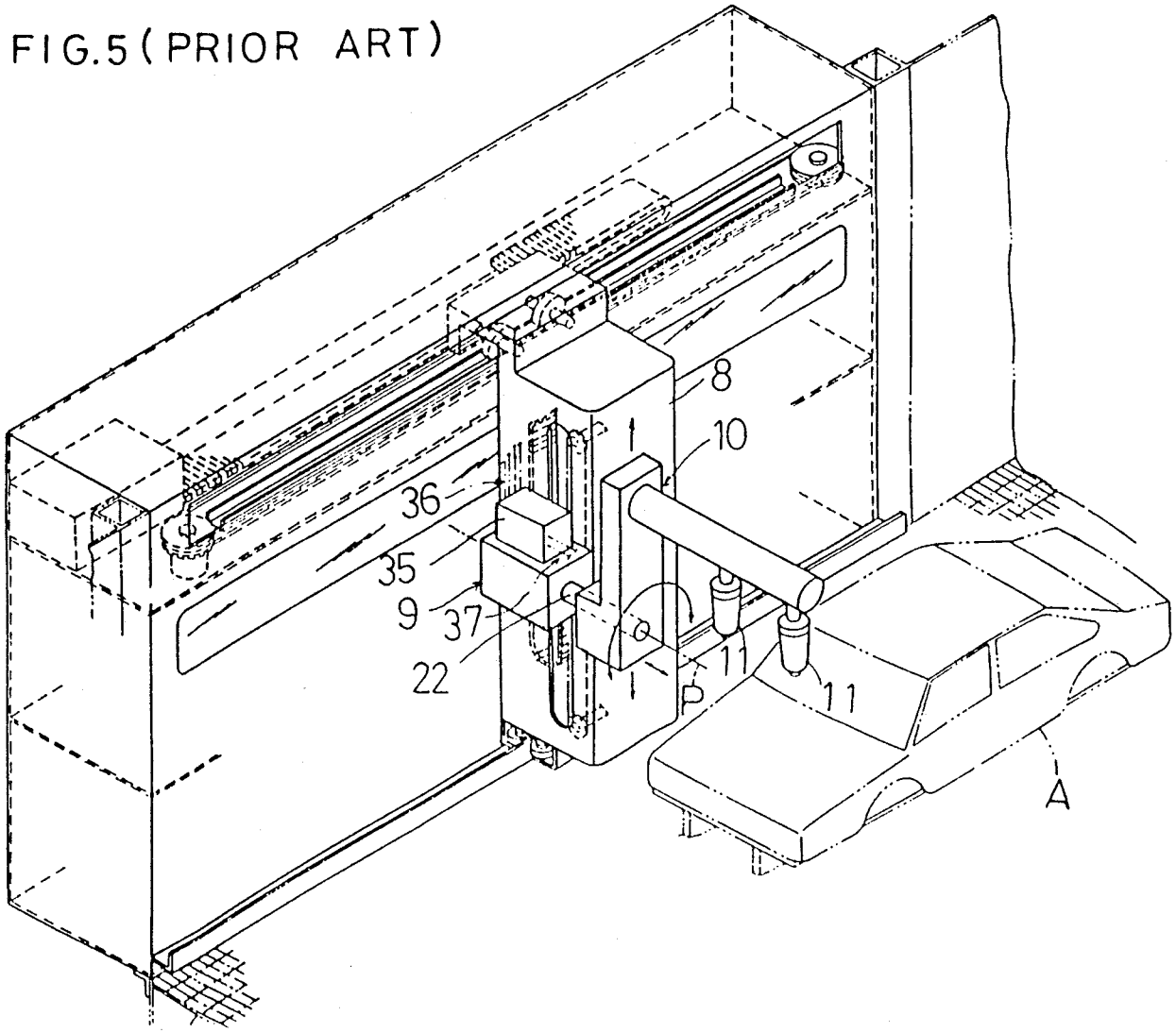
FIG.5 (PRIOR ART)
FIG. 5 is a perspective view showing a conventional apparatus.

For rendering the nozzles 11 movable back and forth along the arm pivot axis P, in place of the above-described mechanism adapted for slidably reciprocating the slide table 12 attached with the nozzles 11 relative to the arm 10, it is also conceivable to employ a different mechanism (see the conventional apparatus of FIG. 5) in which the pivot shaft 22 is rendered slidable along the pivot axis P so as to reciprocate the arm 10 per se along this axis P. In this case, however, with reciprocating actions of the arm 10, the base end of the base arm portion 10*a* repeatedly move to and away from the object A and these approaching motions tend to disturb the flow of ventilation air about the object A, thus resulting in painting quality deterioration.

In this respect, according to the afore-mentioned construction of the embodiment of the present invention, the reciprocating motion of the nozzles 11 does not cause the base end of the base arm portion 10*a* to approach the work object A. Therefore, there will occur no distrubance in the ventilation air flow about the object and consequently no painting quality deterioration of the object.

Each of the nozzles 11 is guided by a spline shaft 33 so that the nozzle can slide along the longitudinal direction of the horizontal arm portion 10*b* relative to the slide table 12. Further, a distance between these nozzles 11 is adjustable by appropriately sliding the respective nozzles 11 relative to the slide table 12. Numeral 35 denotes a valve unit for switching over feed of paint to the nozzles 11. And, this valve unit 35 is attached to the horizontal arm portion 10*b* of the arm 10. Further, a plurality of upstream-side paint feed tubes 36 for separately feeding a plurality of kinds of paint to the nozzles 11 are caused to extend through the base mount 8, the lift unit 9 and the arm 10 to be connected with the valve unit 35. On the other hand, a plurality of downstream-side paint feed tubes for selectively feeding the plurality of kinds of paint through the valve unit 35 to the nozzles 11 are caused to extend on the arm 10 form the valve unit 35 to the nozzles 11.

Some alternate embodiments will be specifically describe next.

(A) It is alterately conceivable to attach the arc-shaped guide 23 to the arm support, i.e. the left unit 9 in the foregoing embodiment, for the arm 10 while providing the arm 10 with the arm pivot drive means (in the foregoing embodiment, the motor 24 and the gear 24*a*) for moving relative to the arc-shaped guide 23 along the periphery of this guide.

(B) The specific construction of the arc-shaped guide 23 which is coaxial with and has a larger diameter than the pivot shaft 22 can be modified conveniently.

(C) The specific construction of the arm pivot drive means for moving relative to the arc-shaped guide 23 along the periphery of this guide can be modified as well depending on the necessity and convenience. Further, the specific connecting construction between this arm pivot drive means and the arc-shaped guide 23 too can be modified from that described in the foregoing embodiment in which the rotary member 24*a* as the drive means and the arc-shaped guide 23 are interconnected via the loop transmission means such as the chain 25.

(D) In case the arm pivot axis P is oriented horizontal, it is conceivable to provide a spring mechanism for providing an urging force to gradually raise the base arm portion 10*a* with increase in the slope of the base arm portion 10*a* of the arm 10 relative to the vertical.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A spray painting apparatus comprising:

an arm attached with a spray nozzle;

a support unit for pivotably supporting the arm via a pivot shaft;

an arc-shaped guide provided to either said arm or said support unit and being coaxial with and larger in diameter than said pivot shaft;

drive means provided to the other and said arm and said support unit so as to move either said support unit or said arm relative to and along a periphery of said arc-shaped guide thereby pivoting said arm; and peripheral support means for supporting said arm along a rotary axis thereof at a position on the outside of said pivot shaft within a pivotable stroke of said arm, while permitting said pivot motion of the arm, said peripheral support means including an arc-shaped rail coaxial with said pivot shaft.

2. A spray painting apparatus according to claim 1, wherein said drive means includes a rotary member rotatable about an axis parallel with a rotary axis of said arm and an open-loop transmission member for transmitting rotational drive force of said rotary member to said arc-shaped guide.

3. A spray painting apparatus according to claim 2, wherein said rotary axis of the arm is oriented substantially horizontal; said drive means being provided to said support unit and said rotary member being disposed upwardly of said arc-shaped guide.

4. A spray painting apparatus according to claim 1, wherein said arm mounts a valve unit for switching over feed of paint to said spray nozzle.

5. A spray painting apparatus claimed in claim 1, wherein said peripheral support means further includes a support arm and a pair of rollers.

* * * * *

UNITED STATES PATENT AND TRADEMARK OFFICE

CERTIFICATE OF CORRECTION

PATENT NO. : 5,085,374

DATED : February 4, 1992

INVENTOR(S) : Masaharu Okuda, Kouichiro Asami and Heishiro Nagasaki

It is certified that error appears in the above-identified patent and that said Letters Patent is hereby corrected as shown below:

Column 2 Line 49 "hardle" should read --hardly--.

Column 4 Line 20 "dropplets" should read --droplets--.

Column 5 Line 3 "left" should read --lift--.

Column 5 Line 25 "left" should read --lift--.

Column 5 Line 39 "slidable" should read --slidably--.

Column 6 Line 17 "form" should read --from--.

Column 6 Lines 19-20 "describe" should read --described--.

Column 6 Line 21 "alterately" should read --alternately--.

Column 6 Line 22 "left" should read --lift--.

Claim 1 Line 67 Column 6 "and" (first occurrence) should read --of--.

Signed and Sealed this

Twenty-ninth Day of June, 1993

*Attest:*

Michael K. Kirk

MICHAEL K. KIRK

*Attesting Officer*

*Acting Commissioner of Patents and Trademarks*